United States Patent [19]

Bennett, Jr.

[11] Patent Number: 4,868,880

[45] Date of Patent: Sep. 19, 1989

[54] METHOD AND DEVICE FOR COMPENSATING FOR PARTIAL HEARING LOSS

[75] Inventor: William R. Bennett, Jr., New Haven, Conn.

[73] Assignee: Yale University, New Haven, Conn.

[21] Appl. No.: 200,870

[22] Filed: Jun. 1, 1988

[51] Int. Cl.[4] ..... H04R 25/00

[52] U.S. Cl. ..... 381/68.2; 381/98

[58] Field of Search ..... 381/13, 98, 68.2, 68.4, 381/94, 103; 84/1.19, DIG. 9

[56] References Cited

U.S. PATENT DOCUMENTS 4,630,305 12/1986 Borth et al. ..... 381/68.2

FOREIGN PATENT DOCUMENTS 159199 10/1982 Japan ..... 381/68.2

2091065 7/1982 United Kingdom ..... 381/68.2

OTHER PUBLICATIONS

Chamberlin, Musical Applications of Microprocessors, 1980, pp. 401–402.

*Primary Examiner*—Forester W. Isen

*Attorney, Agent, or Firm*—Sprung Horn Kramer & Woods

[57] ABSTRACT

A method and device for compensating for partial hearing loss by converting a time domain signal corresponding to a sound into a series of digital component values in the frequency domain, performing a nonlinear amplitude gain operation in the frequency domain on each of the digital component values and converting the digital component values back into a time domain signal corresponding to the sound with compensation for partial hearing loss.

12 Claims, 2 Drawing Sheets

METHOD AND DEVICE FOR COMPENSATING FOR PARTIAL HEARING LOSS

BACKGROUND OF THE INVENTION

The present invention relates to a method and a device for compensating for partial hearing loss.

Methods and devices of this type, otherwise known as hearing aids, are known in the art.

In general, a hearing aid operates by amplifying a sound so that it exceeds the threshold of hearing of the hearing impaired person.

It is known that the frequency response of the human ear is nonlinear. However, one cannot simply amplify all signals at each frequency by the varying distance between the hearing threshold for the impaired person and the normal person. One would quickly exceed the threshold of pain in the partially deaf individual and probably produce even further hearing loss in the process.

SUMMARY OF THE INVENTION

The main object of the present invention is to scale the logarithmic response for normal hearing into a compressed response for a partially deaf individual and thus amplify a sound at different frequencies to achieve a desired sound level over as much of the entire frequency range of hearing which ranges from 20 to 20,000 Hz as is practical for the actual hearing losses in the hearing impaired person.

This and other objects of the present invention are achieved in accordance with the present invention by digital filtering including inserting the required gain-compression in the frequency domain. This digital filtering method and device consists of using a wide band, high resolution A-D converter to feed a microphone signal into a microprocessor, converting this series of numbers into the frequency domain with a Fast Fourier Transform, performing a nonlinear gain operation in the frequency domain on each of the Fourier components, converting the Fourier components back to the time domain with an inverse Fast Fourier Transform and converting the time domain signals back into analog form with a high speed, high resolution D-A converter to feed a device such as an earphone.

In accordance with the present invention, these sets of operations are done in parallel on two independent channels for the left and right ears.

These and other features and advantages of the present invention will be clearly seen from the following detailed description and in reference to the attached drawings, wherein:

DETAILED DESCRIPTION OF THE INVENTION

Figure 1:
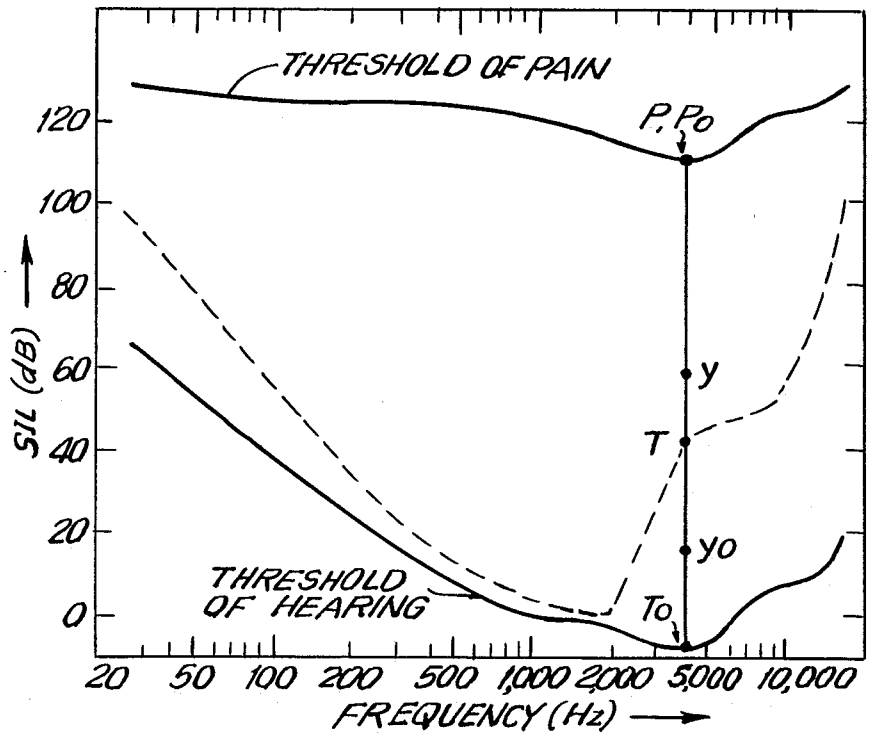
FIG. 1 illustrates the Fletcher-Munson curves with a representative threshold curve in dotted lines for a hearing impaired person superimposed and showing the basis of the method according to the present invention.

FIG. 1 illustrates the Fletcher-Munson curves with the so-called normal or average curves for the threshold of hearing and the threshold of pain for the general population. Such curves represent contours of required Sound Intensity Level (SIL) measured in dB as a function of frequency for the same sensation of loudness and in the original work by Fletcher and Munson were presented as an entire family of curves in 10 dB increments at 1000 Hz. For clarity in the present description, only the boundary curves for the threshold of hearing and the threshold of pain are shown in FIG. 1. Superimposed on these curves is a representative threshold curve in dashed lines for a hearing impaired person. As can be seen from these curves, the thresholds for hearing as well as the thresholds for pain are frequency dependent.

The hearing threshold for the hearing impaired person can be obtained through individual audiograms which are needed for the test subject and are used to obtain the threshold values at each frequency.

In accordance with the present invention, the logarithmic response shown in FIG. 1 for normal hearing is scaled into a compressed response for a partially deaf or hearing impaired individual. Thus at each frequency, the new SIL (Sound Intensity Level) would be $$y=T+(y_o-T_o)(P-T)/(P_o-T_o)\ [\text{dB}] \tag{1}$$

Here $y_o$ is the original SIL, T represents the threshold of hearing, P is the threshold of pain (typically about 120 dB), and the subscript "o" stands for the "normal" or average case. All quantities are functions of the frequency and are in dB where the 0 dB reference Sound Intensity Level is $10^{-16}$ Watts/cm$^2$.

The sound intensity gain in dB is of the form $$G=y-y_o=A-B\,y_o\ [\text{dB}] \tag{2}$$

where the positive constants A and B are given by $$A=(P_oT-T_oP)/(P_o-T_o)\ [\text{dB}] \tag{3}$$

and $$B=(T-T_o+P-P_o)/(P_o-T_o). \tag{4}$$

Thus the intensity gain in dB decreases linearly with input SIL ($y_o$) from its maximum value of $G=T-T_o$ dB at $y_o=T_o$ to 0 dB at $y_o=P_o$, the normal threshold of pain. Because the intensity gain in dB is a linear function of the input sound intensity level, the necessary correction for a hearing-impaired person can be determined by two measurements at each frequency: one at the threshold of hearing and one at the threshold of pain.

The amplitude gain coefficient K, to be provided to a given spectral component in the ideal hearing aid is then a function of the initial sound level at the same frequency given by, $$K=(y-y_o)Ln(10)/20=G/8.6859\ [\text{nepers}] \tag{5}$$

and the full multiplicative amplitude gain is exp (K).

Figure 2:
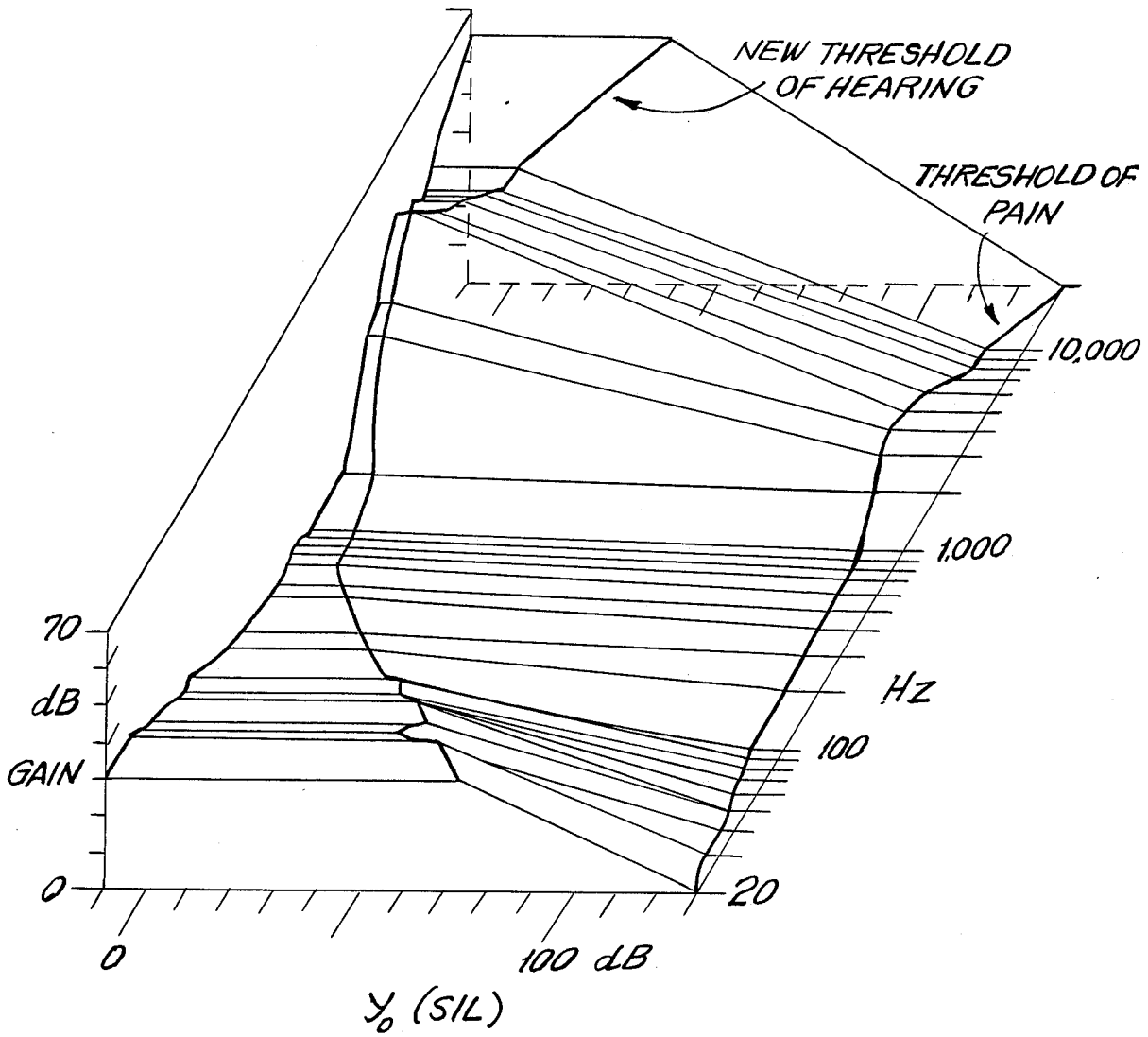
FIG. 2 is a graph according to the invention of intensity gain as a function of input sound intensity for different frequencies.

The desired variation of sound intensity gain versus input sound intensity level (SIL) and frequency is described by a surface of the type shown in FIG. 2. Here the intensity gain is plotted vertically as a function of input sound intensity $y_o$ in the horizontal direction for different frequencies (receding diagonally in the figure) from 20 to 20,000 Hz. In this plot the intensity gain has been limited to the threshold of hearing value for $y_o < T_o$ and limited to the threshold of pain value for $y_o > P_o$. Otherwise the parameters in FIG. 2 correspond to the same ones as in FIG. 1. The added gain causes the new threshold of hearing for the hearing-impaired person to fall directly above the normal threshold values of $y_o$ in the SIL vs frequency plane of the drawing and the intensity gain in dB falls off linearly with input SIL at each frequency so that the surface intersects the SIL vs Frequency plane at the normal threshold of pain.

Because perceived loudness is known to vary logarithmically with SIL, there is an important psychoacoustic advantage in this approach to the hearing compensation problem: namely, the loudness compression is constant over the full dynamic range of the hearing aid for each frequency component. This can be seen quantitatively from Eq.(2) by noting that the rate of change of output intensity with input intensity at constant frequency is $$dy/dy_o = 1 - B = \text{constant} = C[\text{dB/dB}] \quad (6)$$

where B was defined in Eq. (4). The constant, C, which is defined as the "compression", will, of course, vary with frequency. For the specific impairment at 4,000 Hz illustrated by the dashed curve in FIG. 1 and used to construct the surface in FIG. 2, $C = 1 - 0.28 = 0.72$ dB/dB. This means that at 4,000 Hz, an original SIL variation of 10-dB (regarded as an approximate doubling of perceived loudness by the normal ear) would be compressed to a variation of 7.2 dB anywhere within the dynamic range of the hearing aid. Thus, although sound intensities are amplified by varying amounts as a function of input SIL, constant variations at different SIL are transformed into constant variations in the output SIL. This property is desirable for the preservation of relative expression in speech and in musical sound.

Both FIGS. 1 and 2 have been drawn for the case where the threshold of pain (P) for the impaired person is the same as that ($P_o$) for the normal person at each frequency. That, of course, will not necessarily always be the case. In addition, the threshold of pain is hard to establish objectively and painful to determine. As a practical expedient one can replace both threshold of pain values by the normal loudness contours at 100 dB because that would be a limit readily achieved with presently available 16-bit sampling circuitry and it would also reduce the possibility of producing still further physical damage to the impaired ear at high SIL.

The magnitude of the multiplicative amplitude gain, exp(K), to be given each spectral component in the ideal hearing aid is an extremely nonlinear function of the initial sound intensity level at constant frequency and can be computed from the amplitude gain coefficient in Eq. (5). For example, the vertical line drawn at 4000 Hz in FIG. 1 corresponds to an intensity gain varying from about 50-dB at hearing-impaired threshold ($y_o = T$ on the dashed curve in FIG. 1) to 0-dB at the normal threshold of pain ($y_o = P_o$). Over this same range the magnitude of the multiplicative amplitude gain varies in a nonlinear fashion from about 300 to 1. (The amplitude gain coefficient, K, varies from about 5.7 to zero).

It should be emphasized that the frequency-dependent amplitude gain is applied to the amplitude of a particular frequency component after that amplitude has been computed by Fourier analysis over a large number of periods at that frequency. That is, the nonlinear variation in gain occurs at a slow rate compared to the frequencies of the spectral components. For that reason, intermodulation distortion at difference and sum frequencies resulting from different spectral components being mixed by this nonlinearity are largely eliminated. The limiting presence of such nonlinear distortion is determined by the average frequency spacing of the spectral components computed in the Fourier transform and, hence, this distortion decreases as the number of points in the Fourier transform increases. The most objectionable distortion products result from difference frequencies generated from adjacent spectral components in the input signal because such difference frequencies can occur below either primary frequency and in a region where psychoacoustically masking sounds may not be present. For that reason the usable low frequency limit of the hearing aid is determined by the frequency resolution of the FFT process which in turn varies as 1/N, where N is the number of points in the time domain Fourier transform. Specifically, if the usable frequency range of the hearing aid is given by $$f_{min} < f < f_{max}, \quad (7)$$

it follows from the Nyquist criterion that the sample frequency, $f_s$, (at which rate the N points in the FFT are taken) must satisfy $f_s < 2\ f_{max}$. Hence, the number of points in the frequency range $f_{max}$ is N/2 and the limiting frequency resolution of the computed spectrum will have a full power width at half maximum given by $$\Delta f = 2f_{max}/N\ [Hz]. \quad (8)$$

Although the magnitude of the intermodulation distortion products will vary with the actual degree of gain nonlinearity, the most objectionable difference frequency components will fall within the limit given by Eq.(8). Hence, a useful lower frequency cutoff ($f_{min}$) on the hearing aid is twice the FFT resolution and the required number of points in the time-domain FFT is $$N = 4f_{max}/f_{min}, \quad (9)$$

where the allowed values of N are successive powers of 2. For example, a 4096-point FFT would be required to cover the full audio band from 20-Hz to 20,000-Hz at a FFT cycle rate of 10-Hz; a 1024-point FFT would cover the band from 40-Hz to 10,000-Hz at a FFT cycle rate of 20-Hz; a 512-point FFT would cover from 80-Hz to 10,000-Hz at a cycle rate of 40-Hz; and so on.

In order to avoid spurious spectral components resulting from the finite time windows at the FFT cycle frequency, the initial time-dependent signal is multiplied by a Hanning time-window weighting function of the form, $1 - \cos(2\pi t/T)$, where t is the time within the sample period of duration, T. Spurious beat frequencies generated by this multiplicative operation fall within the limiting FFT resolution in Eq. (8) and are smoothed out. Similarly, spurious low frequency modulation effects from the Hanning window fall below the frequency $f_{min}$ in Eqs. (7) and (9) and are negligible.

For stability of the overall circuit in the presence of such large frequency-dependent gain variation, it is desirable to add so-called "minimum-phase" corrections to each spectral component after computing the new spectral amplitude components and before taking the inverse FFT. This can be done using the well-known Bode relations in electric circuit theory. Specifically, the minimum phase shift at frequency $f_o$ that should be added to the signal phase is given by $$\phi_o = -\frac{2f_o}{\pi} \int_0^{+\infty} \frac{K - K_o}{f^2 - f_o^2}\, df \text{ [radians]} \tag{10}$$

where K is the frequency-dependent amplitude gain coefficient gain by Eq. (5) and $K_o$ is the value of that coefficient at frequency $f_o$. In the present case, $K=0$ for $f<f_{min}$ and $f>f_{max}$. Hence, Eq(10) reduces to $$\phi_o = -\frac{2f_o}{\pi} \int_{f_{min}}^{f_{max}} \frac{K - K_o}{f^2 - f_o^2}\, df + \frac{2K_o}{\pi}\left[\frac{f_o}{f_{max}} - \frac{f_{min}}{f_o}\right] \text{[radians]} \tag{11}$$

In practice, the integral in Eq. (11) is computed as a discrete sum over the frequency dependent gain coefficient for each frequency within the band given by Eq. (7). The phase shifts given by Eq. (11) are then added to the phase shifts in the corresponding spectral components of the original signal determined from the initial FFT before performing the inverse FFT to get the digitally filtered signal back in the time domain.

This kind of compressed gain characteristic as a function of frequency is difficult to achieve with purely analog circuitry. Merely breaking up the spectrum into a few broad frequency bands and applying some frequency average gain compression characteristic to each of those bands, which could be achieved with analog circuitry, does not avoid the severe harmonic and intermodulation distortion products produced in the time domain by extremely nonlinear gain characteristics.

Figure 3:
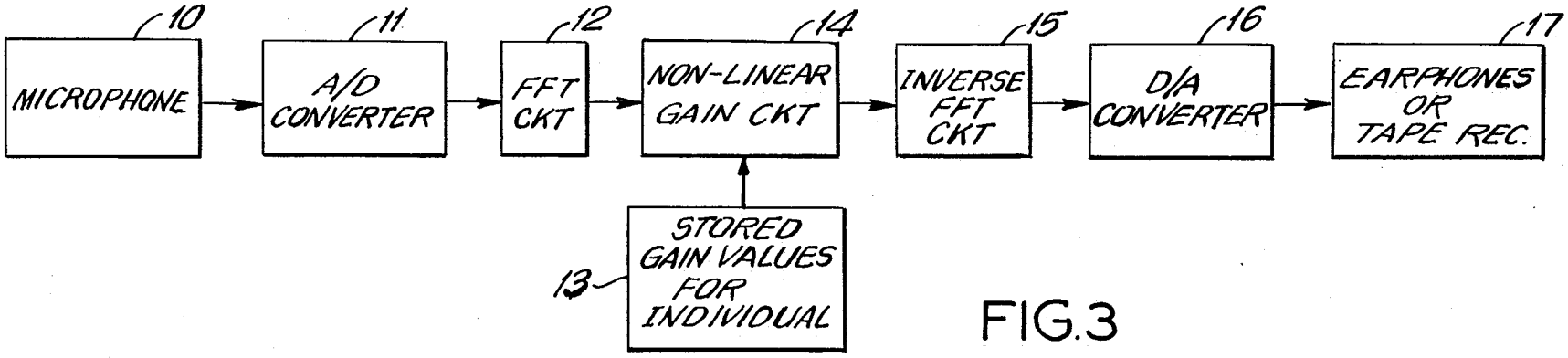
FIG. 3 is a block diagram of the circuitry of the device according to the present invention for carrying out the method of the present invention.

Therefore, as shown in FIG. 3, the nonlinear amplitude gain is achieved by the use of digital filtering by inserting the required gain compression in the frequency domain.

In accordance with he invention, the output of a microphone 10 which is an analog time domain signal, is fed to a wide band high resolution A-D converter 11 which converts the analog output of the microphone 10 into a series of digital numbers. This series of digital numbers from A-D converter 11 is then fed into a Fast Fourier Transform circuit 12 which converts this series of numbers into the frequency domain.

The nonlinear gain characteristic including phase correction at each frequency within the range from 20 to 20,000 Hz is stored in memory 13 and is fed to a nonlinear gain circuit 14 which carries out the nonlinear gain operation in the frequency domain on each of the Fourier components from the circuit 12.

The output from the nonlinear gain circuit 14 is fed into an inverse Fast Fourier Transform circuit 15 which converts the Fourier components back to the time domain. The time domain signals from circuit 15 are thereafter converted back into analog form with a high speed high resolution D-A converter 16 which feeds a transducer 17 such as earphones or a tape recorder.

It is important to note that the implementation of this method depends upon absolute calibration of both microphones and earphones to preserve the 0-dB Sound Intensity Level reference of $10^{-16}$ Watts/cm$^2$. Some adjustment of fixed gain or attenuation is required at each frequency in the circuit to establish this calibration.

To be of practical value for blind persons or persons with hearing impairment in both ears, this set of operations is carried out in two independent channels for the left and right ears.

Anatomical studies of the cochlea show that there are about 3,500 separate (neurological) frequency channels in the ear, implying an average frequency resolution of about 6 Hz over the total bandwidth from 20 to 20,000 Hz. The maximum dynamic range in the central part of the spectrum is about 120-dB, corresponding to 20 bits/-sample resolution. However, this dynamic range drops off substantially at both high and low frequencies as seen in FIG. 1. With the present state of digital circuitry, one can come close to the limits imposed by normal human hearing for such a system operating in real time as can be seen from Table 1.

TABLE 1

| | Good Ear | TI TMS32020 | Motorola DSP56000 |
|---|---|---|---|
| Full Bandwidth | 20 kc/sec | 20 kc/sec | 20 kc/sec |
| Minimum Sample Rate | — | 40 Kc/sec | 40 kc/sec |
| No. Freq. Channels | 3500 | 1024 | 4096 |
| Equiv. FFT | 7000 pts. | 2048 pts. | 8192 pts. |
| Av. Freq. Resolution | 6 c/sec | 20 c/sec | 5 c/sec |
| Dynamic Range | 20 bits (120 dB) | 16 bits (99 dB) | 24 bits (147 dB) |
| Cycle time | — | 50 msec | 200 msec |

The "Cycle time" in Table I is the maximum computing time available per Fourier transform cycle to manipulate a time-window function, do the FFT, the gain-compression computation, and the inverse FFT for the system to work in real time.

An example of a device for carrying out the method in accordance with the present invention, includes an IBM PC/AT Model 339 with 80286 CPU, 3 Mhz, 512K system, 1.2 MB diskette drive, 30 MB fixed disc drive, one 360K drive, monochrome monitor and printer adapter, enhanced keyboard, DOS 3.2, two serial/parallel I/O cards, Professional Graphics controller and Professional high-resolution Graphics Display, Enhanced Graphics Adapter and AST 3-G I/O.

The device also includes an Ariel Corp., Model DSP-16 Real Time Data Acquisition Processor for the IBM PC/AT with options 01-04. This unit, which is manufactured as an Input/Output card for the IBM PC/AT, provides 16 bits/sample resolution on two parallel data processing channels at variable sample rates up to 50-KHz with a 2-MByte RAM internal data unit and uses the Texas Instrument TMS32020 digital signal processing chip, which is user programmable. The card contains enough buffer memory to store up to 12 seconds worth of 16 bit per sample data from two simultaneous channels. This unit carries out the A/D and D/A conversion and the non-linear gain operation. The stored gain values are stored in the computer memory.

Finally, the device includes an Ariel Corp., Model FFT (Fast Fourier Transform) Processor Card for the IBM PC/AT with Options 01-03. This unit, which is manufactured as an Input/Output card for the IBM PC/AT, can do a 1024 point, 16-bit complex FFT and inverse FFT each in 0.2 msec, a 1024 point Hanning time-window in 1.8 msec and can be programmed to handle 2,048-point FFT's. This unit carries out the FFT and inverse FFT conversions.

As a result of the above-mentioned system, two channels of A/D and D/A conversion achieve a 16-bit per sample resolution throughout the audio band. Segments of preprocessed audio signals of about 12 seconds in length permit demonstrating the present method and device for compensating for hearing loss. The Fast Fourier Transform converts the initial test signals into their spectral components and stored data based on an individual audiogram for a test subject permit implementing the multi-channel gain compression in the frequency domain. The inverse Fast Fourier Transform converts the filtered and gain-compressed signals back into the time domain.

It should be understood that this same method could be made to work in real time using the same basic methods with VLSI (Very Large Scale Integrated) circuits of very small size.

It should further be understood that the present invention can also be useful for people with normal hearing but who are in extremely noisy environments so as to impair their ability to hear. For example, a person in the cockpit of a jet plane or a person working in extremely noisy conditions in a factory will exhibit impaired hearing when in that environment and the present invention can be utilized to improve hearing while in such an environment.

It will be appreciated that the instant specification and claims are set forth by way of illustration and not limitation, and that various modifications and changes may be made without departing from the spirit and scope of the present invention.

What is claimed is:

1. A method of compensating for partial hearing loss, comprising the steps of:

a. converting a time domain signal corresponding to a sound into a series of digital component values in the frequency domain;

b. performing a non-linear amplitude gain operation in the frequency domain on each of the digital component values by determining a desired amplitude gain for each of a plurality of spectral component frequencies in the range of 20 to 20,000 Hz and performing the gain operation for each component value according to the desired gain for its corresponding frequency;

c. converting the digital component values from step (b) back into a time domain signal corresponding to the sound with compensation for partial hearing loss; and d. wherein the desired amplitude gain for each frequency is determined according to exp (K), where the amplitude gain coefficient is $K=(y-y_o)Ln(10)/20$ nepers where $y=T+(y_o-T_o)\ (P-T)/(P_o-T_o)$ dB and $y_o$ is the original sound intensity level in dB, T is the threshold of hearing of a hearing impaired listener in dB, $T_0$ is the normal threshold of heating in dB, P is the threshold of pain for the hearing impaired listener in dB, $P_0$ is the normal threshold of pain in dB, and OdB SIL reference level is $10^{-16}$ Watts/cm$^2$.

2. The method according to claim 1, wherein step (a) comprises receiving a first analog signal corresponding to a sound to be heard, converting the first analog signal to a first digital time domain signal and performing a Fast Fourier Transform on the digital time domain signal to obtain a series of digitally represented frequency domain component values.

3. The method according to claim 2, wherein step (c) comprises performing an inverse Fast Fourier Transform to obtain a second digital time domain signal and converting the second digital signal to a second analog time domain signal.

4. The method according to claim 1, wherein step (b) includes the addition of a minimum-phase correction to each spectral component frequency after performing non-linear amplitude gain correction in the frequency domain on each of the digital component values.

5. The method according to claim 4, wherein the desired minimum phase correction $\phi_o$ is determined according to $$\phi_o = -\frac{2f_o}{\pi}\int_{f_{min}}^{f_{max}} \frac{K-K_o}{f^2-f_o^2}\,df + \frac{2K_o}{\pi}\left[\frac{f_o}{f_{max}} - \frac{f_{min}}{f_o}\right] \text{[radians]}$$

$f_{min}$ is the minimum frequency for the hearing aid, $f_{max}$ is the maximum frequency for hearing aid, $\pi=3.14159$ radians $K_o$ is the amplitude gain coefficient at frequency $f_o$ in nepers.

6. The method according to claim 1, wherein steps a-c are carried out in two channels in parallel for two ears.

7. A device for compensating for partial hearing loss, comprising:

a. first means for converting a time domain signal corresponding to a sound into a series of digital component values in the frequency domain;

b. second means for performing a non-linear amplitude gain operation in the frequency domain on each of the digital component values, comprising means for storing a desired amplitude gain for each of a plurality of component frequencies in t he range of 20 to 20,000 Hz and means for performing the gain operation for each component value according to the desired amplitude gain for its corresponding frequency;

c. third means for converting the digital component values from the performing means back into a time domain signal corresponding to the sound with compensation for partial hearing loss; and d. means for determining the desired amplitude gain for each frequency according to exp (K), where the amplitude gain coefficient is $K=(y-y_o)Ln(10)/20$ nepers where $y=T+(y_o-T_o)(P-T)/(P_o-T_o)$ dB and $y_o$ is the original sound intensity level in dB, T is the threshold of hearing of a hearing impaired listener in dB, $T_o$ is the normal threshold of heating in dB, P is the threshold of pain for the hearing impaired listener in dB, $P_o$ is the normal threshold of pain in dB, and OdB SIL reference level is $10^{-16}$ Watts/cm$^2$.

8. The device according to claim 7, wherein the first means for converting comprises means for receiving a first analog signal corresponding to a sound to be heard, means for converting the first analog signal to a first digital time domain signal and means for performing a Fast Fourier Transform on the digital time domain signal to obtain a series of digitally represented frequency domain component values.

9. The device according to claim 8, wherein the third means for converting comprises means for performing an inverse Fast Fourier Transform to obtain a second digital time domain signal and means for converting the second digital signal to a second analog time domain signal.

10. The device according to claim 7, wherein the second means for performing comprises means for storing a desired minimum phase correction for a plurality of component frequencies in the range of 20 to 20,000 Hz and means for performing the minimum phase correction for each component according to a desired minimum phase correction for the corresponding frequency.

11. The device according to claim 10, further comprising means for determining the desired minimum-phase correction to each spectral component after performing the non-linear amplitude gain correction in the frequency domain, wherein the desired minimum phase correction $\phi_o$ is determined according to $$\phi_o = -\frac{2f_o}{\pi} \int_{f_{min}}^{f_{max}} \frac{K - K_o}{f^2 - f_o^2}\, df + \frac{2K_o}{\pi}\left[\frac{f_o}{f_{max}} - \frac{f_{min}}{f_o}\right] \text{[radians]}$$

$K_o$ is the amplitude gain coefficient at frequency $f_o$ in nepers, $f_{min}$ is the minimum frequency for the hearing aid, $f_{max}$ is the maximum frequency for hearing aid.

12. The device according to claim 7, comprising two parallel channels, each channel having said first, second and third means therein and each channel associated with one of two ears.

* * * * *

UNITED STATES PATENT AND TRADEMARK OFFICE

CERTIFICATE OF CORRECTION

PATENT NO. : 4,868,880

DATED : September 19, 1989

INVENTOR(S) : William R. Bennett, Jr.

It is certified that error appears in the above-identified patent and that said Letters Patent is hereby corrected as shown below:

Col. 5, line 10: delete formula and insert:

$$-- \phi_0 = -\frac{2f_0}{\pi}\int_0^{+\infty}\frac{K-K_0}{f^2-f_0^2}df \text{ [radians] } --$$

Col. 5, line 20: delete formula and insert:

$$-- \phi_0 = -\frac{2f_0}{\pi}\int_{f_{min}}^{f_{max}}\frac{K-K_0}{f^2-f_0^2}df + \frac{2K_0}{\pi}\left[\frac{f_0}{f_{max}}-\frac{f_{min}}{f_0}\right]\text{[radians] } --$$

Col. 8, line 22: delete formula and insert:

$$-- \phi_0 = -\frac{2f_0}{\pi}\int_{f_{min}}^{f_{max}}\frac{K-K_0}{f^2-f_0^2}df + \frac{2K_0}{\pi}\left[\frac{f_0}{f_{max}}-\frac{f_{min}}{f_0}\right]\text{[radians] } --$$

UNITED STATES PATENT AND TRADEMARK OFFICE

CERTIFICATE OF CORRECTION

PATENT NO. : 4,868,880

DATED : September 19, 1989

INVENTOR(S) : William R. Bennett, Jr.

It is certified that error appears in the above-identified patent and that said Letters Patent is hereby corrected as shown below:

Col. 10, line 7: delete formula and insert:

$$-- \phi_0 = -\frac{2f_0}{\pi}\int_{f_{min}}^{f_{max}} \frac{K-K_0}{f^2-f_0^2}\,df + \frac{2K_0}{\pi}\left[\frac{f_0}{f_{max}} - \frac{f_{min}}{f_0}\right] [radians] --$$

Signed and Sealed this

Seventeenth Day of March, 1992

*Attest:*

HARRY F. MANBECK, JR.

*Attesting Officer*

*Commissioner of Patents and Trademarks*